US005447484A

United States Patent [19]

Chandler

[11] Patent Number: 5,447,484

[45] Date of Patent: Sep. 5, 1995

[54] ROPE EXERCISE APPARATUS

[76] Inventor: Jerry W. Chandler, 48 Upland Dr., Salem, Va. 24153

[21] Appl. No.: 342,874

[22] Filed: Nov. 21, 1994

[51] Int. Cl.[6] ..... A63B 4/00

[52] U.S. Cl. ..... 482/146; 482/52; 482/91

[58] Field of Search ..... 472/1, 2, 4, 14, 16, 472/18, 25, 29, 30, 34, 44, 91; 482/146, 147, 145, 148, 52, 91

[56] References Cited

U.S. PATENT DOCUMENTS

| | | | |
|---|---|---|---|
| 501,005 | 7/1893 | Goldsmith | 472/4 |
| 735,319 | 8/1903 | Urwick | 482/146 |
| 2,829,891 | 4/1958 | Ludwig | 482/146 |
| 2,906,532 | 9/1959 | Echols | 482/146 |
| 3,103,356 | 9/1963 | Heines | 472/4 |
| 3,511,500 | 5/1970 | Dunn | 482/146 |
| 4,205,839 | 6/1980 | Best | 482/131 |
| 4,257,592 | 3/1981 | Jones . | |
| 4,273,327 | 6/1981 | Nall et al. | 482/146 |
| 4,441,707 | 4/1984 | Bosch . | |
| 5,112,045 | 5/1992 | Mason et al. | 482/146 |
| 5,171,295 | 12/1992 | Schwalm, Jr. . | |
| 5,234,395 | 8/1993 | Miller et al. . | |
| 5,267,923 | 12/1993 | Piaget et al. | 482/80 |
| 5,330,399 | 7/1994 | Fan | 482/146 |
| 5,352,176 | 10/1994 | Huang | 482/146 |

*Primary Examiner*—Jerome W. Donnelly
*Attorney, Agent, or Firm*—Norman B. Rainer

[57] ABSTRACT

An exercise device employs a tether rope that extends longitudinally through an elongated rigid tubular member, and terminates in gripping handles that are held by the exercising person while standing upon the tubular member. The tubular member is pivotably mounted at its centerpoint upon holding plates upwardly emergent from the upper surface of a base platform, thereby having see-saw motion in a vertical plane. An elongated aperture is disposed in the upper surface of the base platform to receive the extremities of the tubular member as they are depressed alternately during the exercise activity.

6 Claims, 2 Drawing Sheets

ROPE EXERCISE APPARATUS

BACKGROUND OF THE INVENTION

1. Field of the Invention

This invention relates to exercising apparatus, and more particularly concerns an exercise apparatus comprising a rope having an intermediate portion extending through a tubular rocking structure and having pull handles at its extremities.

2. Description of the Prior Art

Numerous rope and pulley exercisers have been disclosed in the prior art in two basic forms of exercise apparatus: Isotonic resistance exercisers and Isometric exercisers. Isotonic exercisers provide an adjustable resistance whereby the user's effort is balanced by the resistance of the exerciser, which may be applied asymmetrically. Conversely, isometric exercisers use forces supplied symmetrically by the user on opposite sides of the body, substantially without any resistance in the exerciser mechanism. Many isometric exercisers have been disclosed which, through a series of pulleys, and passages provide means for the user to exercise the upper body muscle groups in a symmetric manner. Resistance is typically applied to each end of a rope device while the ends are pulled alternately to provide resistance through a full range of motion. In this manner, an entire muscle or group of muscles may be exercised.

Various apparatus have been employed in attempts to provide such upper body isometric exercise. For example, U. S. Pat. No. 4,257,592 to Jones discloses a rope and pulley exerciser having a rope elongated between handles and having a portion extending through an elongate tubular structure having pulleys at both extremities. The Jones exerciser is equipped with adjustment means for varying the length of the rope in order to facilitate a variety of exercises. The individual generally stands upon the tubular structure to maintain its position. The presence of pulleys is intended to reduce friction between the rope and tubular structure and to direct the rope. Frictional forces, however, are not necessarily undesirable. For instance, friction may serve to increase the resistance during flexion and reduce the friction during extension in some exercises. Furthermore, frictional forces help to slow the speed of rope travel throughout the range of motion.

U.S. Pat. 5,171,295 to Schwalm, Jr. discloses a similar exerciser having a rope and pulley configuration. This apparatus includes hand grips for alternative types of exercises using the elongate pulley structure. Further accessories include a chair attachment means, ankle straps, and auxiliary backrest.

The Schwalm and Jones devices, as well as many other apparatus, are adapted to provide either upper or lower body isometric exercise exclusively. These devices depend upon the user to immobilize the apparatus through body weight or other means in order to transmit resistive forces. While promoting a good anaerobic muscular workout, such devices often fall short of providing a total body workout simultaneously and are generally incapable of providing good aerobic workout.

It is desirable to both raise heart rate and utilize all muscle groups during exercise in a limited time period. Other types of isometric rope exercisers have addressed these concerns. For instance, U.S. Pat. Nos. 4,441,707 to Bosch and 5,234,395 to Miller et al. disclose belt and rope apparatus adapted to be strapped around the waist of the user while jogging, running, or walking. The Bosch device provides a tubular passage through which a rope may be pulled to provide isometric resistance. The Miller belt provides an elastic snubber means for imparting isotonic resistance to the rope.

While each of the belt devices provides limited ability to exercise the upper body while running, etc. there are inherent disadvantages. A primary drawback is that the belts are generally uncomfortable and are prone to slippage about the runner's waist, particularly in the presence of perspiration. The constant pulling upon the ropes tends to cause the belt to abrade the runners skin. Furthermore, only a limited number of exercises may be performed due to the configuration of the belt, hence only a few muscles are involved. The use of such belts depends upon the ability of the user to run or exercise either outdoors or indoors with the use of a treadmill, exercise bike, etc.

It is therefore an object of the present invention to provide a self contained isometric rope exerciser capable of providing a total body workout for the user.

It is a further object of this invention to provide an exerciser of the aforesaid nature having adjustable rope length.

It is yet another object of this invention to provide an exerciser of the aforesaid nature versatile in the types of exercises that may be performed.

It is still another object of this invention to provide an exerciser of the aforesaid nature which is durable, easily stored and transported, simple to use, and amenable to low cost manufacture.

These and other beneficial objects and advantages will be apparent from the following description.

SUMMARY OF THE INVENTION

The above and other beneficial objects and advantages are accomplished in accordance with the present invention by an isometric resistance rope exerciser comprised of:

a) a base platform defined by flat upper, lower, front, rear and opposed side panels, said upper panel having a slotted aperture elongated in the direction between said side panels, b) an upwardly directed support rail secured to said front panel, c) paired parallel holding plates upwardly directed from said upper panel and disposed in facing relationship across said slotted aperture mid-length thereof, said holding plates having a series of vertically spaced securing holes, d) a rigid tubular conduit of rectangular cross-sectional configuration elongated upon a center axis between opposed extremities, said conduit being bounded by flat upper and lower and opposed side surfaces, said extremities having guide apertures, said side surfaces having opposed aligned mounting holes positioned at the midpoint of said conduit, said conduit being adjustably secured between said holding plates by bolt means penetrating said mounting and securing holes in a manner permitting pivotal movement of said conduit in a vertical plane, e) a compliant non-elongating tether which passes through said conduit, emerges from said guide apertures, and terminates in opposed ends, and f) handle means associated with each end of said tether.

BRIEF DESCRIPTION OF THE DRAWING

For a fuller understanding of the nature and objects of the invention, reference should be had to the following detailed description taken in connection with the accompanying drawing, forming a part of this specification and in which similar numerals of reference indicate corresponding parts in all the figures of the drawing.

DESCRIPTION OF THE PREFERRED EMBODIMENT

Figure 1:
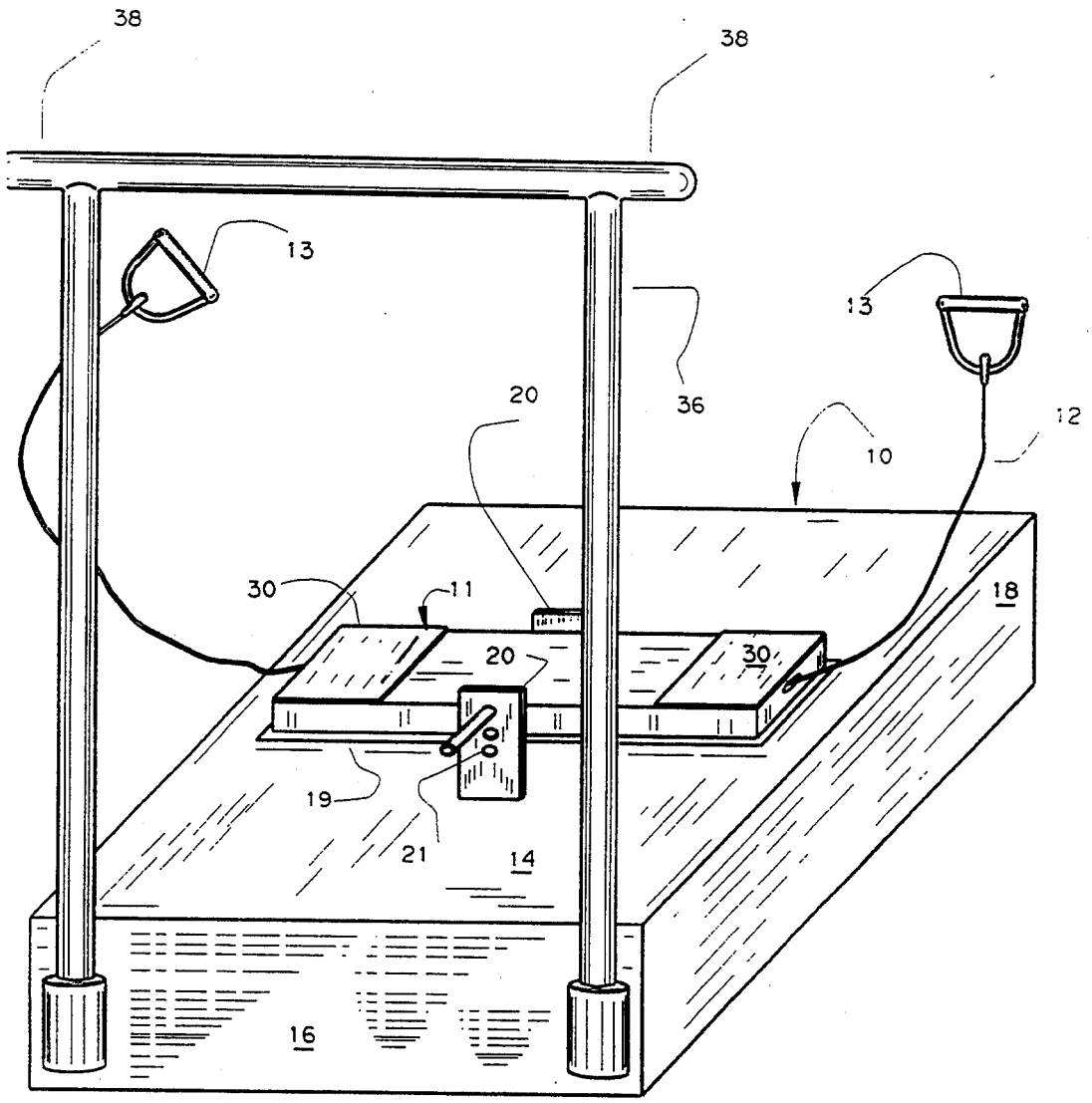
FIG. 1 is a perspective front view of an embodiment of the exercise device of the present invention.
Figure 2:
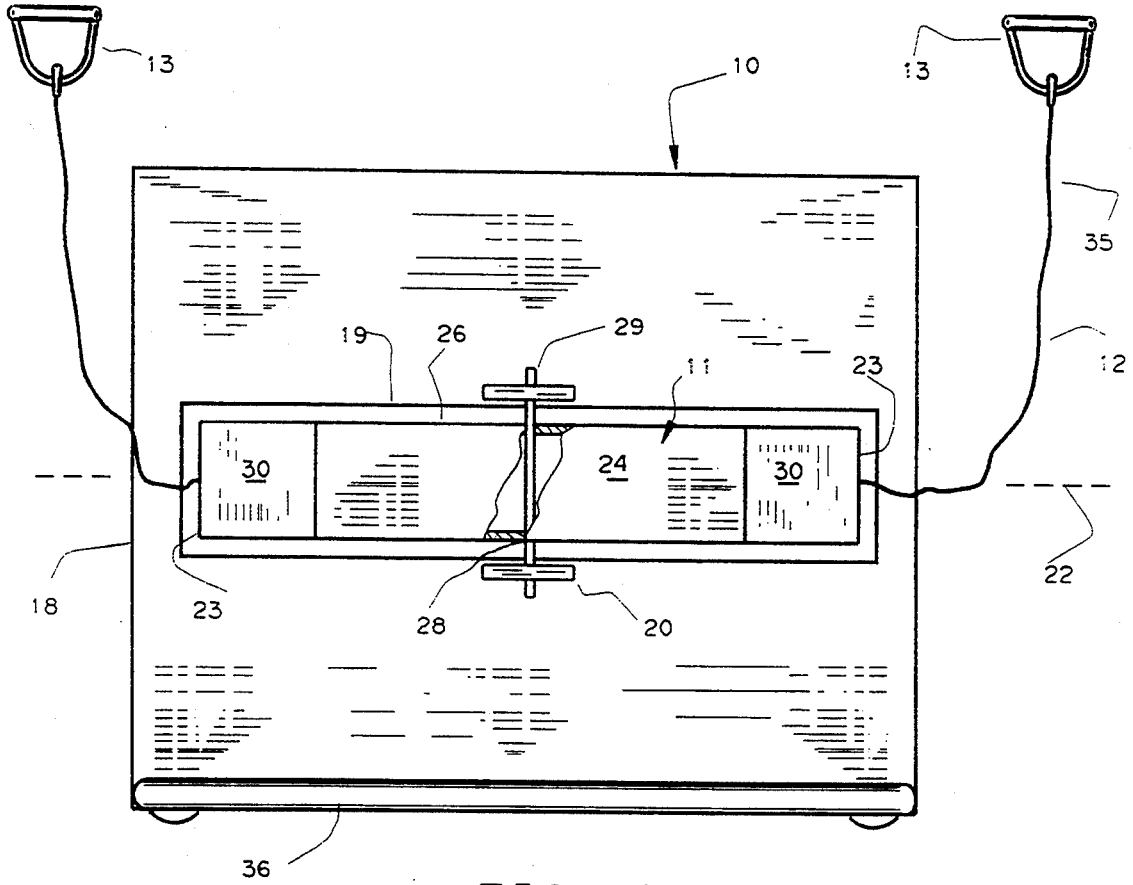
FIG. 2 is a top plan view with portions broken away to reveal interior details.
Figure 3:
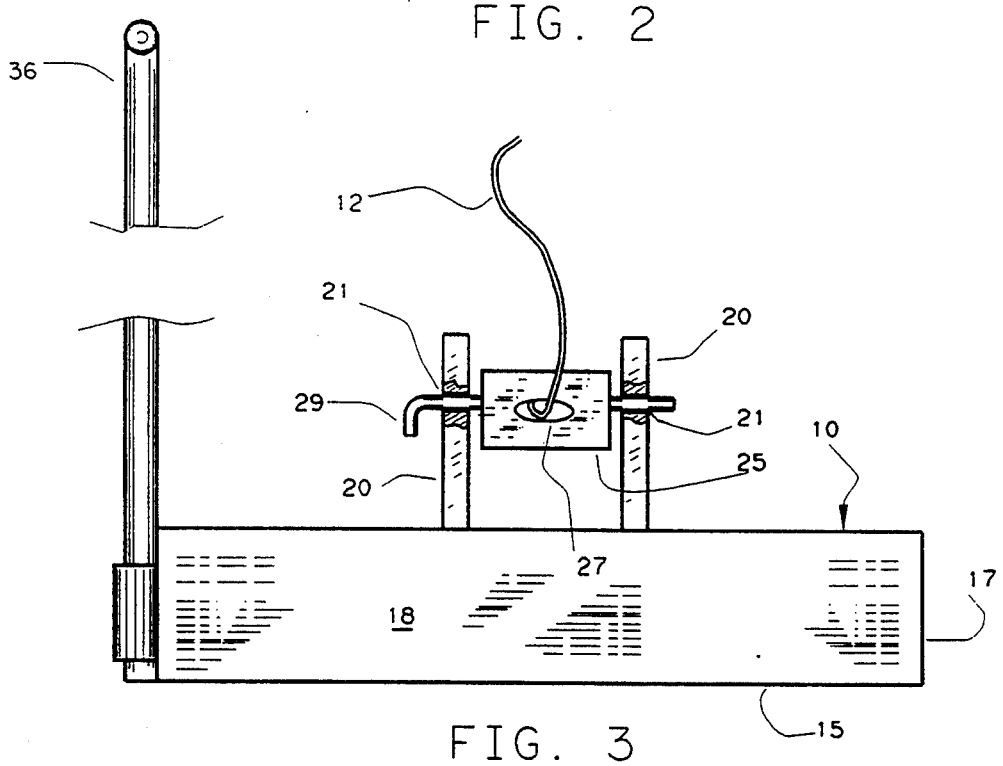
FIG. 3 is a side view.

Referring to FIGS. 1–3, an embodiment of the exercise device of this invention is shown comprised of base platform 10, tubular conduit 11 pivotably supported by said platform, tether rope 12 extending through said conduit, and handles 13 attached to the ends of said tether.

Base platform 10, of rectangular contour and hollow construction, is defined by flat upper and lower panels 14 and 15, respectively, front and rear panels 16 and 17, respectively, and opposed side panels 18. The platform may typically be fabricated of wood, plastic, metal, or other rigid durable material, and may have a height, measured between said upper and lower panels of between about 6 and 12 inches. The length of platform 10, measured between said side panels, may be between about 20 and 36 inches. Likewise, the width of platform 10, measured between said front and rear panels, is between about 20 and 30 inches. A slotted aperture 19 is disposed in upper panel 14 and elongated in the direction between said side panels. A support rail 36 extends upwardly from front panel 16.

Paired parallel holding plates 20 are upwardly directed from said upper panel and disposed in facing juxtaposition across said slotted aperture mid-length thereof. The holding plates have a series of matching vertically spaced securing holes 21.

Conduit 11 is of rectangular cross-sectional configuration, elongated upon center axis 22 between opposed extremities 23. The conduit is defined by flat upper and lower surfaces 24 and 25, respectively, and opposed side surfaces 28. The width of upper surface 24, measured orthogonally between side surfaces 22, is between about 6 and 11 inches. Extremities 23 are equipped with smooth-edged guide apertures 27. Said side surfaces have opposed aligned mounting holes 28 positioned at the midpoint of said conduit. Upper surface 24 is provided with a textured layer 30 which prevents slipping of the user's shoes during the exercise activity.

Conduit 11 is adjustably secured between said holding plates by key bolt 29 which penetrates mounting holes 28 and securing holes 21. The manner of such securement is to permit elevational positioning of the conduit at its midpoint while also permitting pivotal movement about said midpoint in a vertical plane. The length of the conduit is shorter than the length of slotted aperture 19.

Tether 12, which is a compliant but non-elongating structure such as a rope, passes through conduit 11, emerging from guide apertures 27. The length of tether 12, measured between its opposed extremities 35, may range from about 4 to 8 feet. Length adjustment means may be incorporated into said tether. Handles 13 are attached to the ends of the tether.

During use, the exercising person will place both feet upon upper surface 24 of the conduit, which serves as a rocker beam, and will grip the handles in each hand. Employing a walking motion, the conduit will see-saw about bolt 29. The extremities of the conduit may descend into aperture 19 during such motion. The pulling upon the handles is to be coordinated with the motion of the conduit for best exercise effect. Support rail 36 may be employed in an alternative mode of exercise wherein the tether is not utilized. Protruding stubs 38 may be associated with the horizontal bar 39 of support rail 36. The purpose of the stubs is to secure handles 13 when not in use. Horizontal bar 39 may further serve to secure a safety belt or harness which may be employed by the exercising person. Electronic read-out displays may also be positioned on bar 39 for monitoring heart rate, elapsed time, instantaneous exertion level, and cumulative calories burned.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An isometric resistance rope exerciser comprising:

a base platform defined by a flat upper and lower surface, opposed front and rear panels and opposed side panels, said upper surface having formed therein an elongated slotted aperture, having a length and width, said aperture being positioned length-wise between said opposed side panels;

an upwardly directed user support means secured to said front panel, configured so as to allow grasping by a user;

said upper panel further including a pair of holding plates mounted to and extending upwardly therefrom, said plates being positioned in a facing relationship across the width of said slotted aperture and mid-length thereof, said holding plates each having a series of vertically spaced securing holes;

an elongated rigid tubular conduit having a rectangular cross sectional configuration and first and second ends, said conduit further including means positioned mid length of said first and second ends of said conduit so as to allow said conduit to be adjustably and pivotally mounted in a vertical plane about a pivot axis between said holding plates, the length of said conduit is shorter than the length of the slotted aperture and the width of said conduit being narrower than the width of said slotted aperture;

a guide means positioned adjacent each of said first and second ends of said conduit; and a non-elongating tether having a first end and a second end, a first end of said tether being passed through one of said first or second guide means, through the interior of said conduit and passing out of said conduit through the other of said first or second guide means, said tether ends terminating with handle means graspable by a user;

wherein said device is configured to allow a person to place both feet upon the upper surface of said conduit, which serves as a rocker beam and grasp said handle means of said tether one in each hand and employ a rocking motion about said pivot axis, said device being further configured to allow the ends of said conduit to descend into said elongated aperture during such motion.

2. The exerciser of claim 1 wherein said support means includes a horizontally disposed upper member.

3. The exerciser of claim 2 wherein stubs protrude from each extremity of said horizontally disposed member, said stubs being configured to secure said handles when not in use.

4. The exerciser of claim 1 wherein the length of said tether is adjustable between about 4 and 8 feet.

5. The exerciser of claim 1 wherein said platform has a height between 6 and 12 inches, a length between 20 and 36 inches, and a width between about 20 and 30 inches.

6. The exerciser of claim 1 wherein the upper surface of said conduit is provided with a textured layer to prevent slipping of a user's shoes during the exercise activity.

* * * * *